United States Patent [19]

Kessler et al.

[11] 4,335,839

[45] Jun. 22, 1982

[54] COAT HANGER CARRIER

[76] Inventors: Milton Kessler, 6690 Harrington Ave., Youngstown, Ohio 44512; Ronald N. Kessler, 1161 Monsell Dr., Youngstown, Ohio 44505

[21] Appl. No.: 136,904

[22] Filed: Apr. 3, 1980

Related U.S. Application Data

[63] Continuation-in-part of Ser. No. 76,191, Sep. 17, 1979, Pat. No. 4,299,342.

[51] Int. Cl.[3] ..... A45C 13/26

[52] U.S. Cl. ..... 294/142; 248/340

[58] Field of Search ..... 224/45 T, 45 P, 45 Q, 224/46 R; 248/215, 304, 339, 340

[56] References Cited

U.S. PATENT DOCUMENTS

| | | | |
|---|---|---|---|
| 2,598,643 | 5/1952 | Kaplan et al. | 224/45 T X |
| 2,769,587 | 11/1956 | Threeton | 224/45 T |
| 3,744,600 | 7/1973 | Belland et al. | 224/45 T X |
| 3,799,416 | 3/1974 | Schmaltz | 224/45 T |
| 3,804,310 | 4/1974 | Wheeler | 224/45 T |
| 3,961,734 | 6/1976 | Threeton, Sr. | 224/45 T |
| 4,073,457 | 2/1978 | Batts et al. | 248/340 |

*Primary Examiner*—Steven M. Pollard
*Attorney, Agent, or Firm*—Burge & Porter Co.

[57] ABSTRACT

A carrier for releasably receiving, retaining, carrying and hanging hook portions of a plurality of coat hangers includes a C-shaped member having upper and lower portions which overlie each other and which extend substantially in a common plane. The upper leg portion is of sufficient size relative to the size of one's hand to effectively distribute the load of a plurality of garment-carrying hangers across the width of one's hand. The lower leg portion is provided with two openings which extend substantially perpendicular to at least a part of the lower leg portion. One of these openings serves to releasably receive and retain hook portions of a plurality of hangers with such hangers extending substantially perpendicular to the common plane. The other of these openings receives a ring for supporting the carrier on a wall-mounted hook. Recesses or relieved portions of various configurations are preferably provided in the C-shaped member to minimize the amount of material utilized in its formation while still permitting the member to remain strong and stiff.

12 Claims, 16 Drawing Figures

COAT HANGER CARRIER

CROSS-REFERENCE TO RELATED APPLICATIONS

The present application is a continuation-in-part of application Ser. No. 76,191 filed Sept. 17, 1979, now U.S. Pat. No. 4,299,342, entitled COAT HANGER CARRIER, referred to hereinafter as the "Carrier Patent," the disclosure of which is incorporated herein by reference.

REFERENCE TO RELATED DISCLOSURE DOCUMENT

Reference is made herewith to Disclosure Document No. 82,128 filed in the U.S. Patent and Trademark Office on July 2, 1979, disclosing early developmental work relating to the present invention.

BACKGROUND OF THE INVENTION

1. Field of the Invention

The present invention relates generally to a coat hanger carrier of the type intended for use with a garment bag wherein an array of hook portions of loaded coat hangers project from the upper end of the garment bag and must be held together and supported in order to carry the garment bag.

2. Prior Art

It is customary to protectively cover certain hangable garments such as suits, dresses, and coats with a garment bag for travel. The garments are hung on conventional coat hangers and the hangers are aligned with their hook portions arranged in a side-by-side array. A garment bag is then cloaked over the collection of garments and the hanger-hook array is caused to extend through an opening in the top of the bag. Since the hook portions are normally formed of relatively thin wire, it is uncomfortable to hold an array of these heavily loaded hanger-hooks in one's hand while transporting the bag for any significant distance.

In an effort to enlarge the hanger surface area engaged by one's hand in carrying a plurality of loaded hangers, some persons have wrapped tape around the array of hanger hooks. This proposed solution necessitates that tape be removed when access is to be had to garments carried on the hangers, and requires that new tape be applied when one is again ready to travel.

3. The Referenced Carrier Patent

The invention described in the referenced Carrier Patent addresses and overcomes the foregoing and other drawbacks of the prior art by providing a novel and improved carrier for releasably retaining an array of hanger hook portions and for distributing the weight of heavily loaded hangers across the width of one's hand.

A carrier embodying the preferred practice of the Carrier Patent invention includes a substantially C-shaped member having upper and lower leg portions which overlap each other and which extend substantially in a common plane. The upper leg portion is of sufficient size and cross section relative to the size of one's hand to effectively distribute the weight of heavily loaded hangers across the width of one's hand. The lower leg portion has a hanger-hook receiving structure defining an opening which extends parallel to at least a part of the lower leg portion for releasably receiving and retaining hanger-hook portions with their associated hangers extending substantially within the common plane. The receiving structure is located at a position approximately below the center of gravity of the upper leg portion so that the upper leg portion will tend to uniformly load such portions of one's hand as engage it. Carriers of this type enable one to comfortably transport heavily loaded garment bags without excessively stressing one or two fingers as commonly occurs when one tries to directly carry several relatively heavily loaded coat hangers.

A problem not addressed by the invention of the referenced Carrier Patent is that of providing an improved carrier which, while supporting a loaded garment bag, can be hung on a wall-mounted hook of the type normally provided inside the rear seating compartment of an automobile. Wall-mounted hooks of the type normally provided inside the rear seating compartment of an automobile are relatively small in size in comparison with the relatively large cross-section of the carrier described in the referenced Carrier Patent. Such hooks are ordinarily not capable of engaging and supporting a carrier of the type described in the Carrier Patent.

SUMMARY OF THE INVENTION

The present invention overcomes the foregoing and other drawbacks of the prior art by providing a novel and improved carrier for releasably retaining an array of hanger hook portions and for distributing the weight of heavily loaded hangers across the width of one's hand, with the carrier featuring a capability to be hung on relatively small wall-mounted hooks and the like.

A carrier embodying the preferred practice of the present invention includes a substantially C-shaped member having upper and lower leg portions which overlap each other and which extend substantially in a common plane. The upper leg portion is of sufficient size and cross section relative to the size of one's hand to effectively distribute the weight of heavily loaded hangers across the width of one's hand. The lower leg portion has a pair of openings which extend substantially perpendicular to at least a part of the lower leg portion. One of these openings is configured to releasably receive and retain hanger-hook portions with their associated hangers extending substantially perpendicular to the common plane. This hanger-hook receiving opening is located at a position approximately below the center of gravity of the upper leg portion so that the upper leg portion will tend to uniformly load such portions of one's hand as engage it. The other opening receives a ring-shaped member which is engageable with a small wall-mounted hook or the like to permit a loaded carrier to be hung on such a hook. Carriers of this type enable one to comfortably transport heavily loaded garment bags without excessively stressing one or two fingers as commonly occurs when one tries to directly carry several relatively heavily loaded coat hangers.

A feature of the present invention lies in the provision of a coat hanger carrier which can be hung on a small wall-mounted hook to support a loaded garment bag.

A further feature lies in the provision of a carrier which, when hung on a small wall-mounted hook of the type normally found inside the rear seating compartment of an automobile, will cause the hangers of a loaded garment bag to be oriented substantially parallel to the plane of the wall on which the hook is mounted, whereby the loaded garment bag will hang neatly and will occupy a minimum of space.

Yet another feature lies in the provision of a coat hanger carrier which can be releasably secured to hanger hook portions and which, when utilized to carry a plurality of relatively heavily loaded hangers, will present no sharp edges or corners to cause discomfort to the person using the carrier.

A further feature of the present invention lies in the provision of a coat hanger carrier which can be fabricated sufficiently economically and inexpensively that it can be sold for a relatively low price or given away as a sales promotion item. The body of the carrier is preferably molded as a single piece and is preferably formed from relatively inexpensive plastics material. The only other component of the carrier is a conventional ring member of the type commonly employed as a key ring.

A further feature of the invention lies in the provision of a coat hanger carrier which will remain releasably attached to a plurality of coat hangers even when one's hand is no longer serving to orient the carrier in a particular attitude with respect to the hangers.

Still another feature lies in the provision of a coat hanger carrier which can be hung on a hook or a coat rod for storing either the carrier itself or for storing a loaded garment bag.

A fuller understanding of these and other features of the invention will be had by referring to the following description and claims taken in conjunction with the accompanying drawings.

DESCRIPTION OF THE PREFERRED AND ALTERNATE EMBODIMENTS

Figure 1:
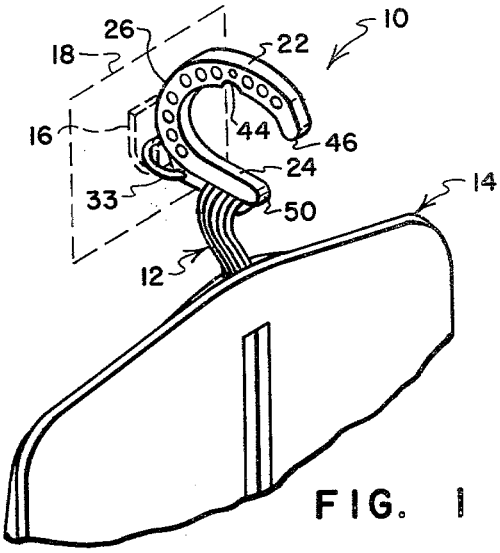
FIG. 1 is a perspective view showing a preferred embodiment of coat hanger carrier in receiving relationship with hanger-hook portions projecting upwardly from a garment bag, the carrier being hung from a wall-mounted hook depicted in phantom.

Referring to FIGS. 1–4, a coat hanger carrier of the type embodying the preferred practice of the present invention is indicated generally by the numeral 10. In FIG. 1, the carrier 10 is shown in receiving relationship with a plurality of hanger-hook portions 12 which project upwardly from an opening in the top of a garment bag 14. As will be understood, the garment bag 14 protectively shrouds a plurality of garments (not shown) carried on bottom portions (not shown) of hangers whose hook portions 12 project upwardly from the garment bag 14.

In FIG. 1, a small wall-mounted hook is shown in phantom and designated by the numeral 16. The plane of a wall on which the hook 16 is mounted is indicated by the numeral 18. A feature of the carrier 10 lies in the manner in which it orients the hanger hooks 12 so that the hangers in the loaded garment bag 14 will be oriented to substantially parallel the plane of the wall 18 when the carrier 10 is hung on the hook 16, as shown in FIG. 1.

Referring to FIGS. 1–7, the coat hanger carrier 10 includes a substantially C-shaped member 20 having upper, lower and central portions 22, 24, 26 which overlie each other and which extend in substantially a common plane. The upper leg portion 22 is of sufficient size relative to the size of one's hand to effectively distribute the load of a plurality of heavily ladened garment-carrying hangers across the width of one's hand. The lower leg portion 24 is provided with a hanger-hook receiving structure 30. A pair of openings 31, 32 extend through the lower leg portion 24 in directions substantially perpendicular to the common plane of the upper, lower and central portions 22, 24, 26. The opening 31 receives a metal ring 33 for hanging the carrier 10 from a wall-mounted hook or the like. The opening 32 is configured to releasably receive and retain hanger hook portions of a plurality of coat hangers with the hangers being oriented to extend substantially perpendicular to the common plane of the portions 22, 24, 26 of the C-shaped member.

The upper, lower and central leg portions 22, 24, 26 have flat side surfaces 40, 42. While a plurality of recesses or relieved portions 41 are preferably formed in the surfaces 40, 42 to minimize the amount of plastics material consumed in the production of the carrier 10, portions 43 of the side surfaces 40, 42 are left uninterrupted by the recesses 41 to provide planar surface portions onto which a suitable name or other imprint may be inscribed, as indicated by the letters "NAME" in FIG. 2.

A notch 44 is formed in the underside of the upper leg portion 22 to facilitate hanging the carrier 10 on a coat rod, either by itself or while supporting a loaded garment bag as depicted in FIG. 1. A rounded formation 46 is provided at the end of the upper leg portion 22. A rounded formation 50 is provided at the end of the lower leg portion 24.

Figure 2:
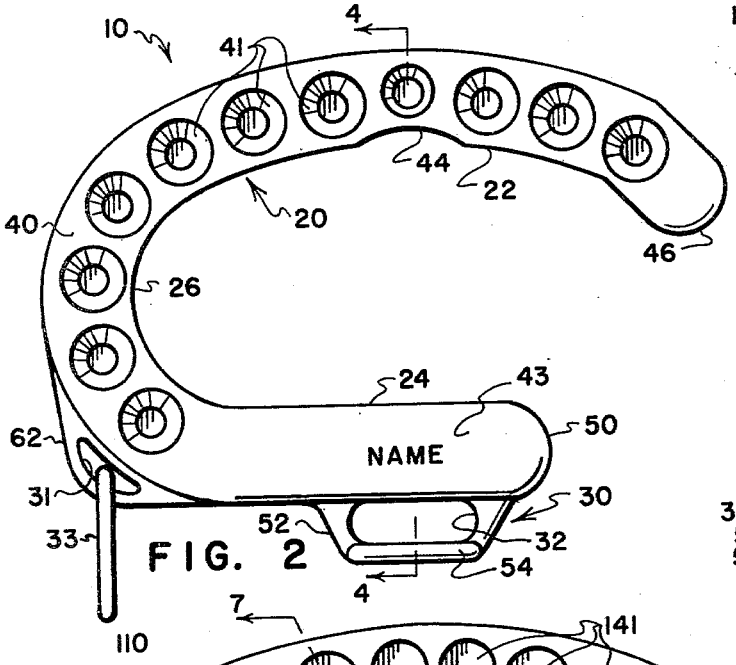
FIG. 2 is a front side elevational view, on an enlarged scale, of the carrier of FIG. 1.
Figure 3:
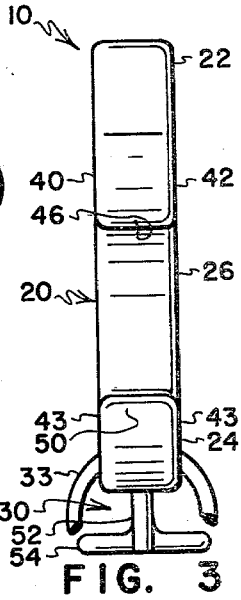
FIG. 3 is an end elevational view of the carrier of FIG. 1.
Figure 4:
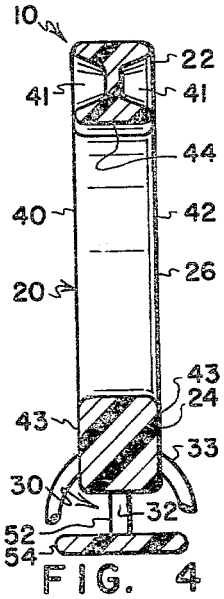
FIG. 4 is a sectional view as seen from a plane indicated by a line 4—4 in FIG. 2.

Referring to FIGS. 2–4, the receiving structure 30 has a depending central web 52 through which the elongate opening 32 is formed. A pair of feet 54 project in opposite directions from the web 52 at locations below the opening 32 to reinforce the web 52 and to assist in stabilizing hanger hook portions 12 which may be inserted through the opening 32.

A central web 62 projects outwardly from the lower and central leg portions 24, 26 near their juncture. The opening 31 is formed through the web 62. The metal ring 33 is a conventional helically wound spring steel member of the type commonly used as a key ring. The ring 33 fits relatively loosely within the opening 31 and can pivot with respect to the main body of the carrier 10 so that the ring 33 can be moved into engagement with any suitably configured hook, such as the wall-mounted hook 16 shown in phantom in FIG. 1.

Figure 5:
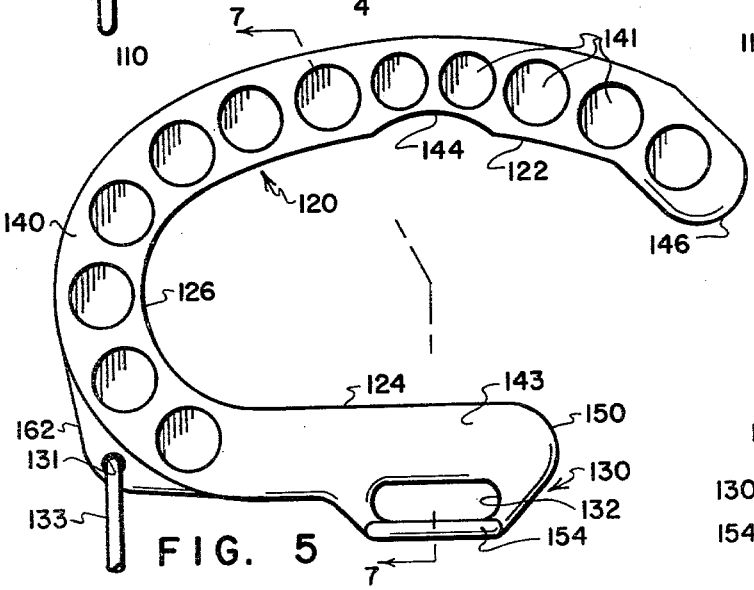
FIGS. 5–7 are side, end and sectional views similar to FIGS. 2–4, showing a first alternate embodiment.
Figure 6:
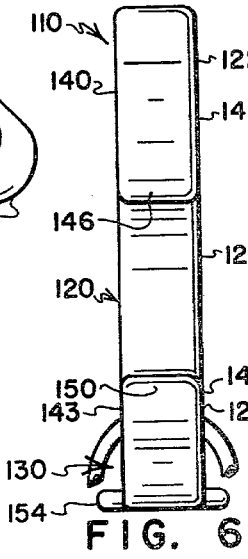
Figure 7:
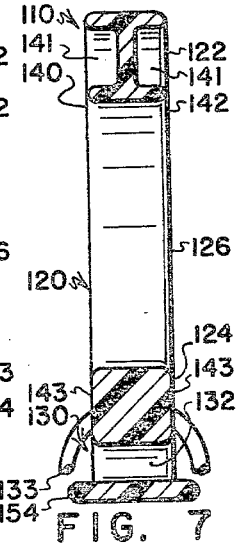

Referring to FIGS. 5–7, a coat hanger carrier of the type embodying a first alternate practice of the present invention is indicated generally by the numeral 110. Since the carrier 110 is quite similar in configuration to that of the carrier 10, corresponding components of the carriers 10, 110 are designated by numerals which differ in magnitude by the number one hundred.

The carrier 110 includes a substantially C-shaped member 120 having upper, lower and central portions 122, 124, 126 which overlie each other and which extend in substantially a common plane. The upper leg portion 122 is of sufficient size relative to the size of one's hand to effectively distribute the load of a plurality of heavily ladened garment-carrying hangers across the width of one's hand. The lower leg portion 124 is provided with a hanger-hook receiving structure 130. A pair of openings 131, 132 extend through the lower leg portion 124 in directions substantially perpendicular to the common plane of the upper, lower and central portions 122, 124, 126. The opening 131 receives a metal ring 133 for hanging the carrier 110 from a wall-mounted hook or the like. The opening 132 is configured to releasably receive and retain hanger hook portions of a plurality of coat hangers with the hangers being oriented to extend substantially perpendicular to the common plane of the portions 122, 124, 126.

The upper, lower and central leg portions 122, 124, 126 have flat side surfaces 140, 142. While a plurality of recesses or relieved portions 141 are preferably formed in the surfaces 140, 142 to minimize the amount of plastics material consumed in the production of the carrier 110, portions 143 of the side surfaces 140, 142 are left uninterrupted by the recesses 141 to provide planar surface portions onto which a suitable name or other imprint may be inscribed.

A notch 144 is formed in the underside of the upper leg portion 122 to facilitate hanging the carrier 110 on a coat rod, either by itself or while supporting a loaded garment bag as depicted in FIG. 1. A rounded formation 146 is provided at the end of the upper leg portion 122. A rounded formation 150 is provided at the end of the lower leg portion 124.

The receiving structure 130 is formed as a contiguously depending part of the lower leg portion 124. A pair of feet 154 project in opposite directions at locations below the opening 132 to reinforce the receiving structure 130 and to assist in stabilizing hanger hook portions which may be inserted through the opening 132.

A central web 162 projects outwardly from the lower and central leg portions 124, 126 near their juncture. The opening 131 is formed through the web 162. The metal ring 133 is a conventional helically wound spring steel member of the type commonly used as a key ring. The ring 133 fits relatively loosely within the opening 131 and can pivot with respect to the main body of the carrier 110 so that the ring 133 can be moved into engagement with any suitably configured hook, such as the wall-mounted hook 16 shown in phantom in FIG. 1.

Figure 8:
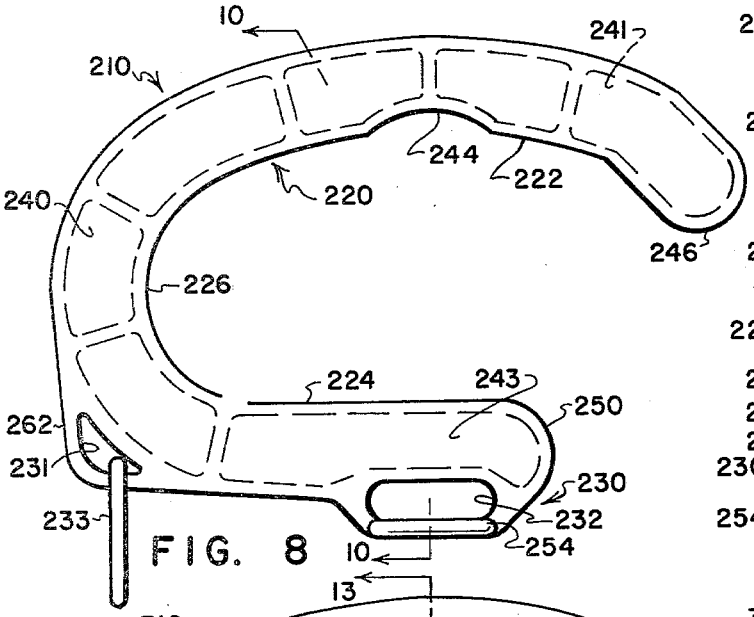
FIGS. 8–10 are side, end and sectional views similar to FIGS. 2–4, showing a second alternate embodiment.
Figure 9:
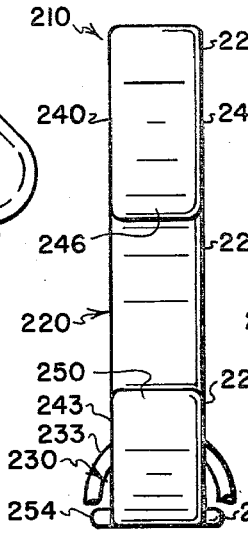
Figure 10:
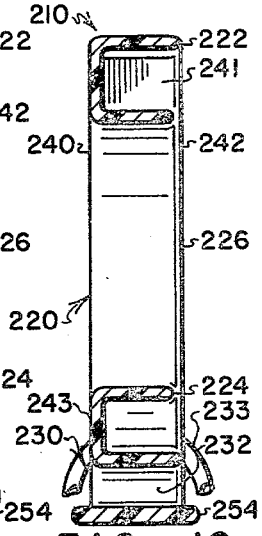

Referring to FIGS. 8–10, a coat hanger carrier of the type embodying a second alternate practice of the present invention is indicated generally by the numeral 210. Since the carrier 210 is quite similar in configuration to that of the carrier 10, corresponding components of the carriers 10, 210 are designated by numerals which differ in magnitude by the number two hundred.

The carrier 210 includes a substantially C-shaped member 220 having upper, lower and central portions 222, 224, 226 which overlie each other and which extend in substantially a common plane. The upper leg portion 222 is of sufficient size relatively to the size of one's hand to effectively distribute the load of a plurality of heavily ladened garment-carrying hangers across the width of one's hand. The lower leg portion 224 is provided with a hanger-hook receiving structure 230. A pair of openings 231, 232 extend through the lower leg portion 224 in directions substantially perpendicular to the common plane of the upper, lower and central portions 222, 224, 226. The opening 231 receives a metal ring 233 for hanging the carrier 210 from a wall-mounted hook or the like. The opening 232 is configured to releasably receive and retain hanger hook portions of a plurality of coat hangers with the hangers being oriented to extend substantially perpendicular to the common plane of the portions 222, 224, 226 of the C-shaped member.

The upper, lower and central leg portions 222, 224, 226 have flat side surfaces 240, 242. While a plurality of recesses or relieved portions 241 are preferably formed in the surfaces 240, 242 to minimize the amount of plastics material consumed in the production of the carrier 210, portions 243 of the side surfaces 240, 242 are left uninterrupted by the recesses 241 to provide planar surface portions onto which a suitable name or other imprint may be inscribed.

A notch 244 is formed in the underside of the upper leg portion 222 to facilitate hanging the carrier 210 on a coat rod, either by itself or while supporting a loaded garment bag as depicted in FIG. 1. A rounded formation 246 is provided at the end of the upper leg portion 222. A rounded formation 250 is provided at the end of the lower leg portion 224.

The receiving structure 230 is formed as a contiguously depending part of the lower leg portion 224. A pair of feet 254 project in opposite directions at locations below the opening 232 to reinforce the receiving structure 230 to assist in stabilizing hanger hook portions which may be inserted through the opening 232.

A corner portion 262 projects from the lower and central leg portions 224, 226 near their juncture. The opening 231 is formed through the corner portion 262. The metal ring 233 is a conventional helically wound spring steel member of the type commonly used as a key ring. The ring 233 fits relatively loosely within the opening 231 and can pivot with respect to the main body of the carrier 210 so that the ring 233 can be moved into engagement with any suitably configured hook, such as the wall-mounted hook 16 shown in phantom in FIG. 1.

Figure 11:
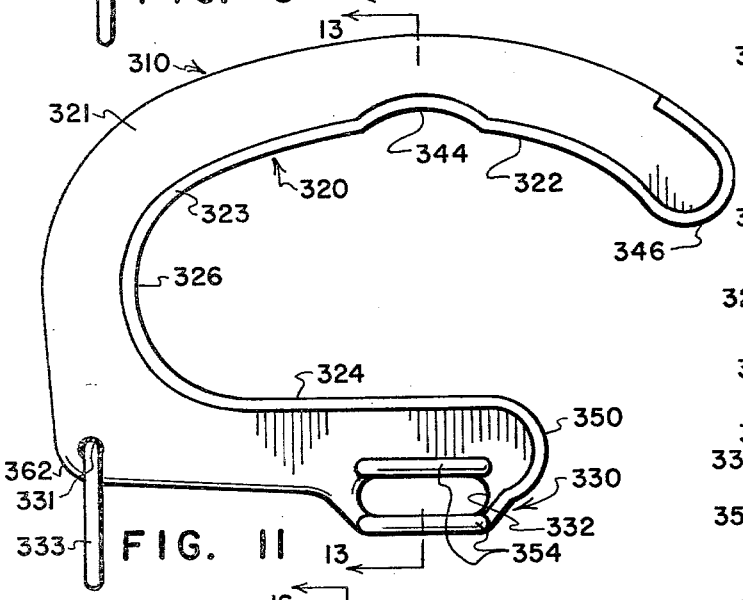
FIGS. 11–13 are side, end and sectional views similar to FIGS. 2–4 showing a third alternate embodiment; and, FIGS. 14–16 are side, end and sectional views similar to FIGS. 2–4 showing a fourth alternate embodiment.
Figure 12:
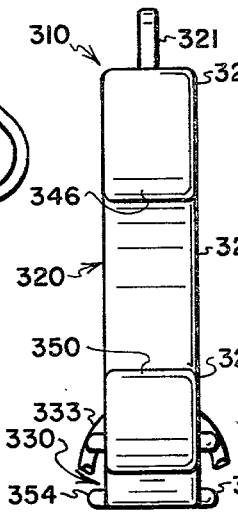
Figure 13:
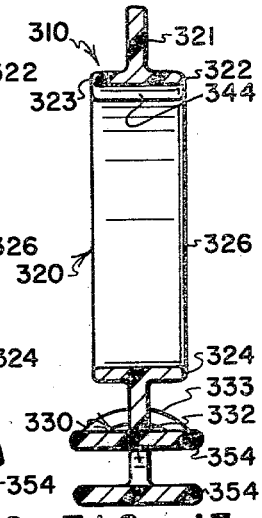

Referring to FIGS. 11–13, a coat hanger carrier of the type embodying a third alternate practice of the present invention is indicated generally by the numeral 310. Since the carrier 310 is quite similar in configuration to that of the carrier 10, corresponding components of the carriers 10, 310 are designated by numerals which differ in magnitude by the number three hundred.

The carrier 310 includes a substantially C-shaped member 320 having upper, lower and central portions 322, 324, 326 which overlie each other and which extend in substantially a common plane. The upper leg portion 322 is of sufficient size relative to the size of one's hand to effectively distribute the load of a plurality of heavily ladened garment-carrying hangers across the width of one's hand. The lower leg portion 324 is provided with a hanger-hook receiving structure 330. A pair of openings 331, 332 extend through the lower leg portion 324 in directions substantially perpendicular to the common plane of the upper, lower and central portions 322, 324, 326. The opening 331 receives a metal ring 333 for hanging the carrier 310 from a wall-mounted hook or the like. The opening 332 is configured to releasably receive and retain hanger hook portions of a plurality of coat hangers with the hangers being oriented to extend substantially perpendicular to the common plane of the portions 322, 324, 326 of the C-shaped member.

The upper, lower and central leg portions 322, 324, 326 are of essentially T-shaped cross-section as defined by a central web 321 and a transversely extending web 323. The T-shaped cross-section minimizes the amount of plastics material consumed in the production of the carrier 310. The central web provides planar surface portions onto which a suitable name or other imprint may be inscribed.

A notch 344 is formed in the underside of the upper leg portion 322 to facilitate hanging the carrier 310 on a coat rod, either by itself or while supporting a loaded garment bag as depicted in FIG. 1. A rounded formation 346 is provided at the end of the upper leg portion 322. A rounded formation 350 is provided at the end of the lower leg portion 324.

The receiving structure 330 is formed as a depending part of the lower leg portion 324. Two pairs of feet 354 project in opposite directions at locations above and below the opening 332 to reinforce the receiving structure 330 and to assist in stabilizing hanger hook portions which may be inserted through the opening 332.

A corner portion 362 projects from the lower and central leg portions 324, 326 near their juncture. The opening 331 is formed through the corner portion 362. The metal ring 333 is a conventional helically wound spring steel member of the type commonly used as a key ring. The ring 333 fits relatively loosely within the opening 331 and can pivot with respect to the main body of the carrier 310 so that the ring 333 can be moved into engagement with any suitably configured hook, such as the wall-mounted hook 16 shown in phantom in FIG. 1.

Figure 14:
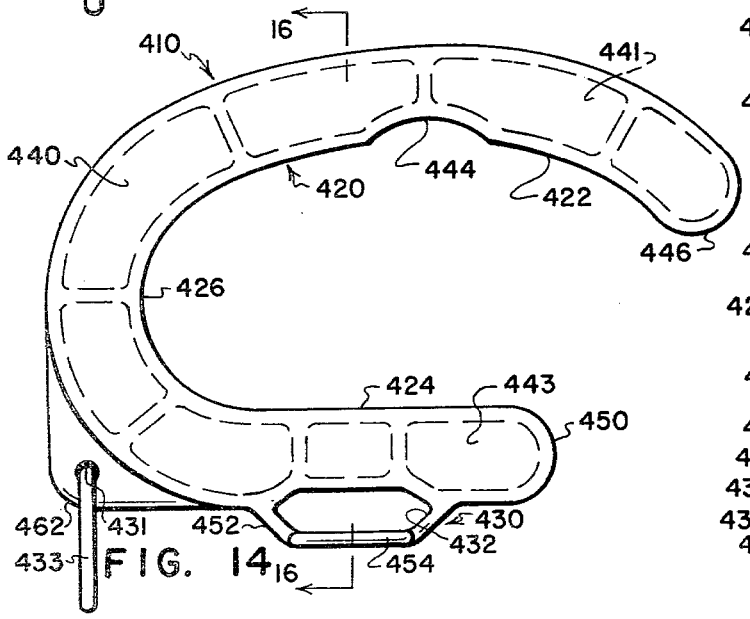
Figure 15:
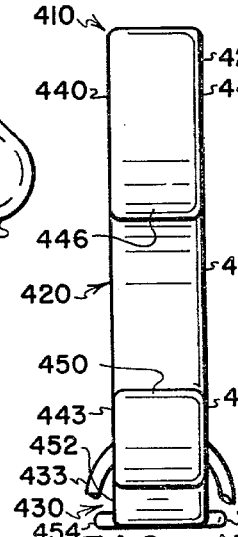
Figure 16:
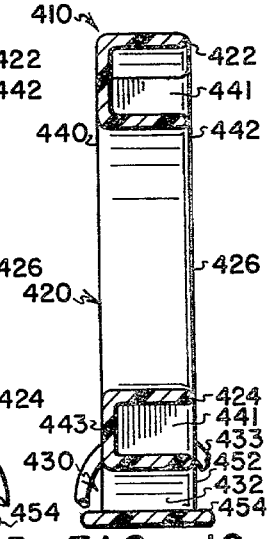

Referring to FIGS. 14–16, a coat hanger carrier of the type embodying a fourth alternate practice of the present invention is indicated generally by the numeral 410. Since the carrier 410 is quite similar in configuration to that of the carrier 10, corresponding components of the carriers 10, 410 are designated by numerals which differ in magnitude by the number four hundred.

The carrier 410 includes a substantially C-shaped member 420 having upper, lower and central portions 422, 424, 426 which overlie each other and which extend in substantially a common plane. The upper leg portion 422 is of sufficient size relative to the size of one's hand to effectively distribute the load of a plurality of heavily ladened garment-carrying hangers across the width of one's hand. The lower leg portion 424 is provided with a hanger-hook receiving structure 430. A pair of openings 431, 432 extend through the lower leg portion 424 in directions substantially perpendicular to the common plane of the upper, lower and central portions 422, 424, 426. The opening 431 receives a metal ring 433 for hanging the carrier 410 from a wall-mounted hook or the like. The opening 432 is configured to releasably receive and retain hanger hook portions 412 of a plurality of coat hangers with the hangers being oriented to extend substantially perpendicular to the common plane of the portions 422, 424, 426 of the C-shaped member.

The upper, lower and central leg portions 422, 424, 426 have flat side surfaces 440, 442. While a plurality of recesses or relieved portions 441 are preferably formed in the surfaces 440, 442 to minimize the amount of plastics material consumed in the production of the carrier 410, portions 443 of the side surfaces 440, 442 are left uninterrupted by the recesses 441 to provide planar surface portions onto which a suitable name or other imprint may be inscribed.

A notch 444 is formed in the underside of the upper leg portion 422 to facilitate hanging the carrier 410 on a coat road, either by itself or while supporting a loaded garment bag as depicted in FIG. 1. A rounded formation 446 is provided at the end of the upper leg portion 422. A rounded formation 450 is provided at the end of the lower leg portion 424.

The receiving structure 430 is formed as a contiguously depending part of the lower leg portion 424. A pair of feet 454 project in opposite directions at locations below the opening 432 to reinforce the receiving structure 430 and to assist in stabilizing hanger hook portions 412 which may be inserted through the opening 432.

A central web 462 projects outwardly from the lower and central leg portions 424, 426 near their juncture. The opening 431 is formed through the web 462. The metal ring 433 is a conventional helically wound spring steel member of the type commonly used as a key ring. The ring 433 fits relatively loosely within the opening 431 and can pivot with respect to the main body of the carrier 410 so that the ring 433 can be moved into engagement with any suitably configured hook, such as the wall-mounted hook 16 shown in phantom in FIG. 1.

As will be apparent from the foregoing description, the present invention provides several novel and improved carrier embodiments for receiving, transporting and storing a plurality of heavily loaded garment hangers. The carriers 10, 110, 210, 310, 410 will not unduly stress one's hand when used to transport heavily laden garment bags. Moreover, these carriers may be hung on small wall-mounted hooks and the like to support heavily loaded garment bags.

Although the invention has been described in its preferred form with a certain degree of particularity, it will be understood that the present disclosure of the preferred embodiment has been made only by way of example and that numerous changes may be resorted to without departure from the true spirit and scope of the invention as hereinafter claimed. It is intended that the patent shall cover, by suitable expression in the appended claims, whatever features of patentable novelty exist in the invention disclosed.

What is claimed is:

1. A carrier for releasably receiving, retaining, carrying and hanging hanger hook portions of a plurality of coat hangers comprising:

(a) a substantially C-shaped member having upper and lower leg portions which overlie each other and which extend substantially in a common plane;

(b) the upper leg portion being of a sufficient size relative to the size of one's hand to effectively distribute the load of a plurality of garment-carrying hangers across the width of one's hand;

(c) the lower leg portion having hanger-hook receiving means for defining an opening which extends substantially perpendicular to said common plane for releasably receiving and retaining hanger-hook portions of a plurality of coat hangers with such hangers oriented to extend substantially perpendicular to said common plane;

(d) wall-mounted hook receiving means connected to the C-shaped member for receiving a wall-mounted hook to hang the carrier on such hook, the wall-mounted hook receiving means being configured to orient the common plane of the C-shaped member in a direction extending substantially perpendicular to the plane of the wall on which the wall-mounted hook is mounted so that such hangers as are received by the carrier are oriented by the carrier to extend in a direction substantially parallel to the plane of such wall; and, (e) the lower leg portion having a pair of formations extending in directions substantially perpendicular to said common plane on opposite sides of said common plane at a location adjacent said opening for stabilizing hanger hook portions which may be inserted through said opening.

2. The carrier of claim 1 wherein the hanger-hook receiving means is formed as an integral, one-piece part with the C-shaped member.

3. The carrier of claim 1 wherein the wall-mounted hook receiving means includes a ring-like member extending through a hole formed through a selected part of the C-shaped member.

4. The carrier of claim 3 wherein the hole and the opening extend in directions substantially parallel to each other.

5. The carrier of claim 1 wherein the receiving means includes a web portion which depends from other portions of the lower leg portion and the opening is formed through the web.

6. A carrier for releasably receiving, retaining, carrying and hanging hanger hook portions of a plurality of coat hangers comprising:

(a) a substantially C-shaped member having upper and lower leg portions which overlie each other and which extend substantially in a common plane;

(b) the upper leg portion being of a sufficient size relative to the size of one's hand to effectively distribute the load of a plurality of garment-carrying hangers across the width of one's hand;

(c) the lower leg portion having hanger-hook receiving means for defining an opening which extends substantially perpendicular to said common plane for releasably receiving and retaining hanger-hook portions of a plurality of coat hangers with such hangers oriented to extend substantially perpendicular to said common plane;

(d) wall-mounted hook receiving means connected to the C-shaped member for receiving a wall-mounted hook to hang the carrier on such hook, the wall-mounted hook receiving means being configured to orient the common plane of the C-shaped member in a direction extending substantially perpendicular to the plane of the wall on which the wall-mounted hook is mounted so that such hangers as are received by the carrier are oriented by the carrier to extend in a direction substantially parallel to the plane of such wall; and (e) a pair of feet projecting in opposite directions from the common plane at locations below the opening.

7. The carrier of claim 1 wherein the C-shaped member is formed from plastics material, and selected portions of the C-shaped member are provided with recess means for diminishing the amount of plastics material required to form the C-shaped member.

8. The carrier of claim 1 wherein the C-shaped member has at least one flat surface portion formed thereon for receiving a name inscription.

9. The carrier of claim 1 wherein notch means is provided in the lower surface of the upper leg portion for facilitating hanging the carrier on a conventional closet rod with the rod received in the notch means.

10. The carrier of claim 1 wherein the wall-mounted hook receiving means includes:

(a) a portion which projects away from other portions of the C-shaped member;

(b) a hole formed through the projecting portion; and, (c) ring means extending through the hole for receiving a wall-mounted hook to support the carrier from such hook.

11. The carrier of claim 10 wherein the hole and the opening extend in substantially parallel directions.

12. The carrier of claim 1 wherein said formations are located below said opening.

* * * * *